US006850169B2

(12) United States Patent
Manavi et al.

(10) Patent No.: US 6,850,169 B2
(45) Date of Patent: Feb. 1, 2005

(54) EMERGENCY TRAFFIC SIGNAL DEVICE

(76) Inventors: Payam Manavi, 4069 Caminito Suero, San Diego, CA (US) 92122; Keyvan T. Diba, 11841 Goshen Ave., #4, Los Angeles, CA (US) 90049

( * ) Notice: Subject to any disclaimer, the term of this patent is extended or adjusted under 35 U.S.C. 154(b) by 84 days.

(21) Appl. No.: 10/440,547

(22) Filed: May 16, 2003

(65) Prior Publication Data

US 2004/0008127 A1 Jan. 15, 2004

Related U.S. Application Data

(60) Provisional application No. 60/380,941, filed on May 17, 2002, and provisional application No. 60/380,925, filed on May 17, 2002.

(51) Int. Cl.[7] ..... G08G 1/00

(52) U.S. Cl. ..... 340/902; 340/906; 340/815.47; 340/691.6

(58) Field of Search ..... 340/901–904, 340/906, 907, 929, 691.1, 691.6, 815.45, 815.47, 815.42; 455/227, 228

(56) References Cited

U.S. PATENT DOCUMENTS 3,257,641 A * 6/1966 Campana et al. ..... 340/906
5,014,052 A * 5/1991 Obeck ..... 340/906
6,072,407 A * 6/2000 Shin ..... 340/907

* cited by examiner

*Primary Examiner*—Donnie L. Crosland
(74) *Attorney, Agent, or Firm*—Birch, Stewart, Kolasch & Birch, LLP; Thomas M. Small

(57) ABSTRACT

An emergency traffic signal device comprising a plurality of elongated display units that are affixed to the traffic signal around the three traffic lights thereon and comprise arrays of LEDs capable of displaying graphic directional instructions in the form of moving chevrons or arrows that indicate the need to move laterally to the side of the road in response to preemptive signals detected by a controller. The display units are mounted on channel-shaped bodies to be retrofitted to the signal, or are installed as original equipment on new signals, preferably in a continuous band around the traffic lights. Alternatively, message display panels, also responsive to the controller, are applied to one or both of the upper and lower sides of the traffic signal, and additional arrays of LEDs are provided in the positions of two of the traffic lights to emit standard color lights during normal operation and to display graphic directional symbols in response to emergency signals.

25 Claims, 8 Drawing Sheets

EMERGENCY TRAFFIC SIGNAL DEVICE

REFERENCE TO PRIOR PROVISIONAL APPLICATIONS

This application claims the benefit of prior now abandoned provisional applications Ser. Nos. 60/380,941, and 60/380,925, both filed May 17, 2002.

BACKGROUND OF THE INVENTION

This invention relates to traffic signals for controlling traffic flow at intersections of roadways, and relates more particularly to systems and devices that modify traffic signal operation in response to preemptive emergency vehicle signals to permit the emergency vehicle to pass quickly and safely through the intersection, and to methods of controlling such signals.

Traffic signals have been used for many years to regulate traffic flow at intersections, typically providing a green or "go" light for traffic on one street at preselected intervals while providing traffic on the intersecting street with a red or "stop" light. During the transition from "go" to "stop", it is customary to provide a yellow or "caution" light for a short interval, warning oncoming motorists to prepare to stop when the red light appears. All three lights often are mounted in a common housing or frame, usually in a vertical row but sometimes horizontally aligned.

When an emergency vehicle such as a police car, fire truck or ambulance must pass rapidly through an intersection, the oncoming emergency vehicle typically sounds an audible warning such as a siren and a visual warning such as a flashing light, and then proceeds through the intersection without regard to the existing condition of the traffic signal. For various reasons, these signals are not always sufficient to avoid collisions. Loud noises, closed vehicles with radios or other audio devices playing, and inattentive drivers in some instances lead to dangerous situations in which cross traffic does not stop for the oncoming emergency vehicle, with resulting collisions.

A variety of methods, systems and devices have been proposed to allow emergency vehicles to control traffic signals. These typically use radio transmitter systems for activating emergency preemption controls on the traffic signals that will override the normal controls of the signals and provide "stop" signals for cross traffic approaching the intersection and continuous "go" signals for the emergency vehicle. Other special signals have been provided in efforts to provide information to affected drivers regarding the presence and direction of approach of emergency vehicles, whether on intersecting streets or from one direction or the other on the same street. Such systems and devices are well known, and examples are shown in U.S. Pat. Nos. 4,775,865 and 4,704,610 (signs beside traffic signals with vehicle symbols for indicating approaching emergency vehicles); U.S. Pat. No. 6,292,109 (display at comer of intersection with sign shown in FIG. 6 having arrows indicating the direction of an approaching vehicle, a traffic signal with a siren and a flashing red emergency light); and 6,362,749 (signal device installed in vehicles and having arrows for indicating the direction of the signal from an approaching emergency vehicle, which also could be installed in an undisclosed manner on a traffic signal).

Unfortunately, these prior devices, systems and methods have provided ambiguous and sometimes confusing information and often have been so complex and expensive in construction that they have not been universally installed. Others have been unreliable in operation and have required substantial time and money for maintenance. Accordingly, there has been an ongoing need for an improved and more effective emergency traffic signal device and method that will overcome the deficiencies of the prior art systems and devices.

BRIEF SUMMARY OF THE INVENTION

The present invention resides in a novel traffic signal device that can be either attached to existing traffic signals or installed in newly constructed signals, and is effective to provide improved visual warning communications to drivers regarding the approach of an emergency vehicle and the actions that are required to avoid the emergency vehicle, and the accompanying method of controlling the traffic signal. For these purposes, a first embodiment of the invention comprises a set of attachments that mount to the frame or housing of the traffic signal and are arranged around the standard traffic lights, and preferably substantially surrounding them, to provide clearer and unambiguous visual instructions for emergency situations in a highly visible and instructive manner. In its most basic form, this device comprises a set of elongated individual attachments that are mountable on the existing backing panel of standard traffic signals, and contain display elements that are capable of providing visual directional signals such as chevrons, arrows or other graphics (moving or stationary) for indicating the direction of movement that is necessary to avoid an oncoming emergency vehicle, and can rely upon preexisting preemptive signals and appropriately control the traffic lights. A variation of this embodiment, or another embodiment, also contemplates the design of the backing panels of new traffic light assemblies to provide the improved signal device surrounding the panel as part of the original equipment.

A second embodiment of the invention adds to the traffic signal and the set of attachments one or more electro-optically responsive traffic signal lamps, preferably two or three, that are capable of producing the standard traffic signals during normal operations and, in response to preemptive signals from emergency vehicles, also are capable of producing clear graphic directional or "stop" signals, as appropriate. These signals also can be chevrons, arrows or other graphics.

A third embodiment of the invention adds to the traffic signal and the set of attachments one or more message display panels for displaying additional, usually verbal, messages to supplement the graphic instructions provided by the other elements. These messages can be various emergency or informative messages, preferably pre-programmed, or original messages produced on command, and can be flashing messages, scrolling messages, or otherwise.

In all embodiments, the method of controlling the traffic signal through providing the attachments and controller and actuating the display units to display the special directional signals also is part of the invention.

Other aspects and advantages of the present invention will be evident from the following drawings, taken in conjunction with the accompanying detailed description.

DETAILED DESCRIPTION

Figure 1:
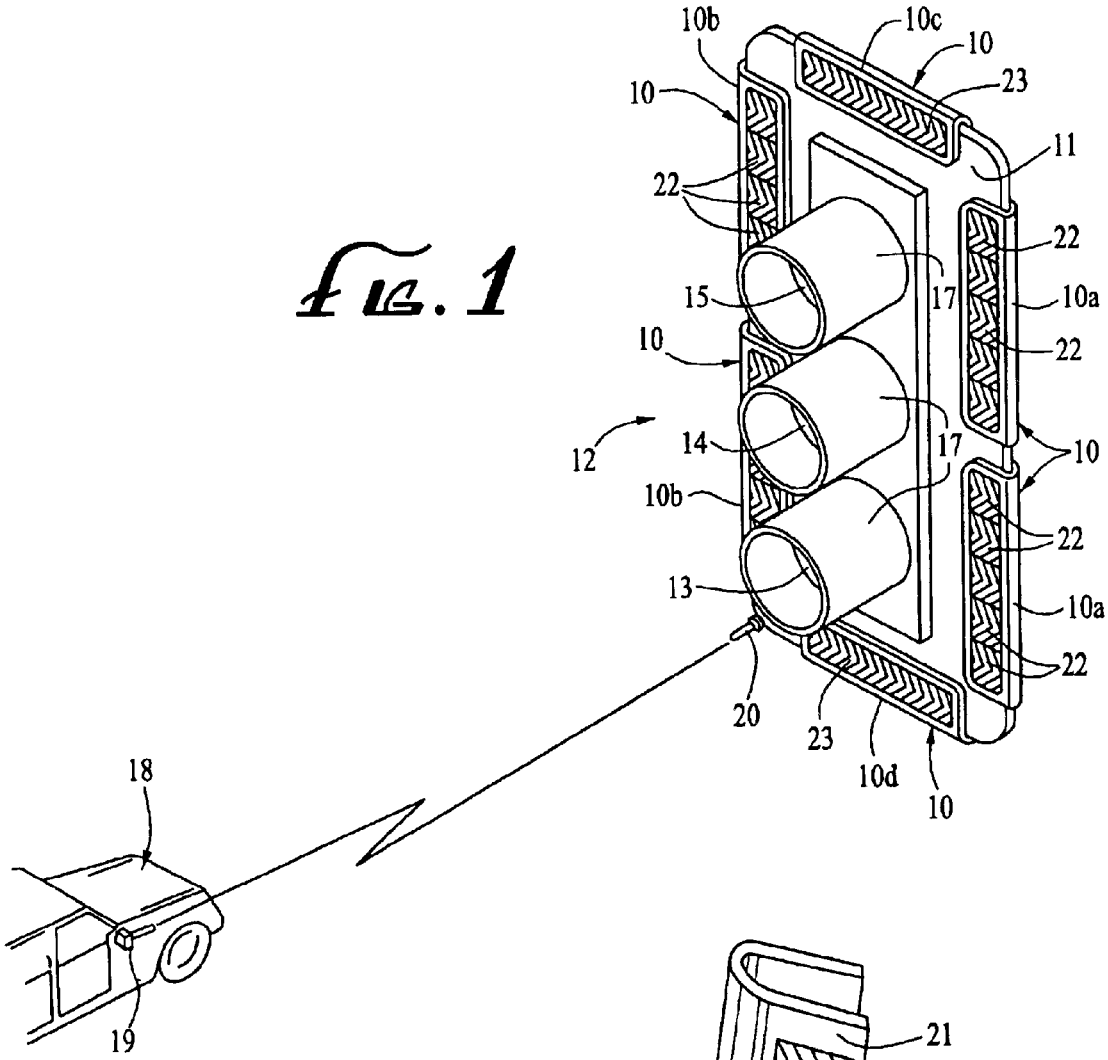
FIG. 1 is a fragmentary perspective view showing a portion of an approaching emergency vehicle, not to scale, and a representative traffic signal equipped with an emergency traffic signal device in accordance with a first embodiment of the present invention.

As shown in the drawings for purposes of illustration, the invention is embodied in a device, indicated generally by the reference number 10, that is mounted on the backing panel 11 of a conventional traffic signal 12 having green, red and yellow lamps 13, 14 and 15, each comprising a suitable light source (not shown) and an open-ended shroud or shade 17. A representative emergency vehicle 18 is shown in a position approaching the traffic signal 12 and having a transmitter 19 of a conventional type for actuating an emergency control system (not shown) for the traffic signal. The controller receives the transmitted radio signal through an antenna 20 and electronically actuates various features of the invention in response to the radio signals received from emergency vehicles that are travelling on the same street or other roadway or on an intersecting street or other roadway. The details of construction, electronics and operation of such controllers in these systems are known, as is indicated in the several patents that are identified in the background of this invention.

It has been customary in past systems of this type to enable the emergency vehicles to control the normal, "stop" and "go" signals of the intersection. In addition, some systems sometimes provide signals that indicate the direction of an approaching emergency vehicle and enable drivers of other automobiles, trucks and the like, and even other emergency vehicles, to make decisions as to appropriate evasive actions to avoid interference, or even a collision, with the vehicle that is sending the emergency signal. Typically, as indicated in the cited prior patents, such signals indicate, at most, the direction from which the emergency vehicle is approaching, and leave it to the other drivers to decide what kind of evasive action is appropriate.

In accordance with the present invention, the device 10 is an improved emergency signal device that provides clear and unambiguous information to drivers as to the specific action or actions needed to avoid the oncoming emergency vehicle. In addition, the improved signal device is relatively simple and inexpensive in construction and may be economically retrofitted to existing traffic signals or provided as an original component of a new traffic signal that is to be installed.

Figure 2:
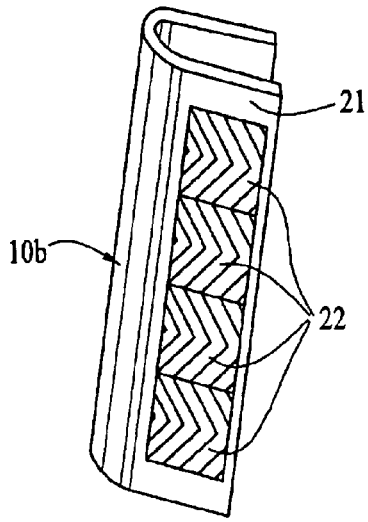
FIG. 2 is an enlarged perspective view of one of the attachment elements of the emergency signal device of FIG. 1.
Figure 3:
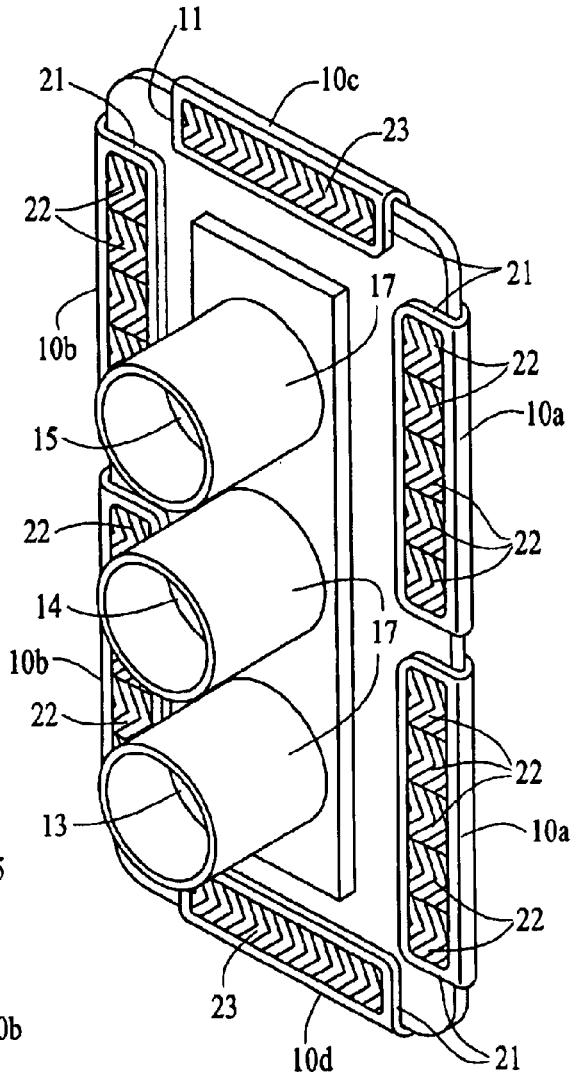
FIG. 3 is a front perspective view of the emergency signal device of FIG. 1.

For these purposes, the device 10 herein comprises a set of attachments, separately indicated at 10*a* and 10*b* on the lateral sides of the backing panel 11 and 10*c* and 10*d* on the upper and lower sides, and each having a channel-shaped body 21, as shown most clearly in FIG. 2, that is fitted over the backing panel and has one or more electro-optically responsive flat display units on its front side facing in the same direction as the traffic lamps 13, 14 and 15. The channel-shaped body may be composed of suitable metal or plastic, and sized to fit tightly over the backing panel and be suitably secured in place. In this way, the attachments are affixed to the backing panel. The display units may take various well-known forms, preferably being arrays of light-emitting diodes ("LEDs") that are capable of emitting light to form contrasting graphic patterns, such as the chevron patterns shown in FIGS. 1, 2 and 3 and elsewhere. When deactivated, they typically will appear as simply a blank panel.

It can be seen in FIGS. 1 and 2 that each of the lateral side elements 10*a* and 10*b* is shown as having a plurality of standard, substantially square display units 22 arranged in a row to provide one elongated unit in each side element 10*a* and 10*b*, and the upper and lower attachments comprise one elongated rectangular display unit 25. With this arrangement, each lateral side unit 10*a*, 10*b* can display a chevron pattern, providing a plurality of chevrons on each attachment element, and the upper and lower units can provide an elongated continuous chevron pattern. This pattern, through sequential control of the activation of the LEDs, can be made to appear to be moving in the direction of the desired movement, to the right in the drawings, or could be stationary as well, whichever is regarded as the most effective manner of giving instructions. The result is a graphic display surrounding the standard traffic signal and providing an almost continuous peripheral band of visual signals. A moving chevron or arrow (see FIG. 14) is the preferred directional signal, but any other effective symbol may be used.

Figure 4:
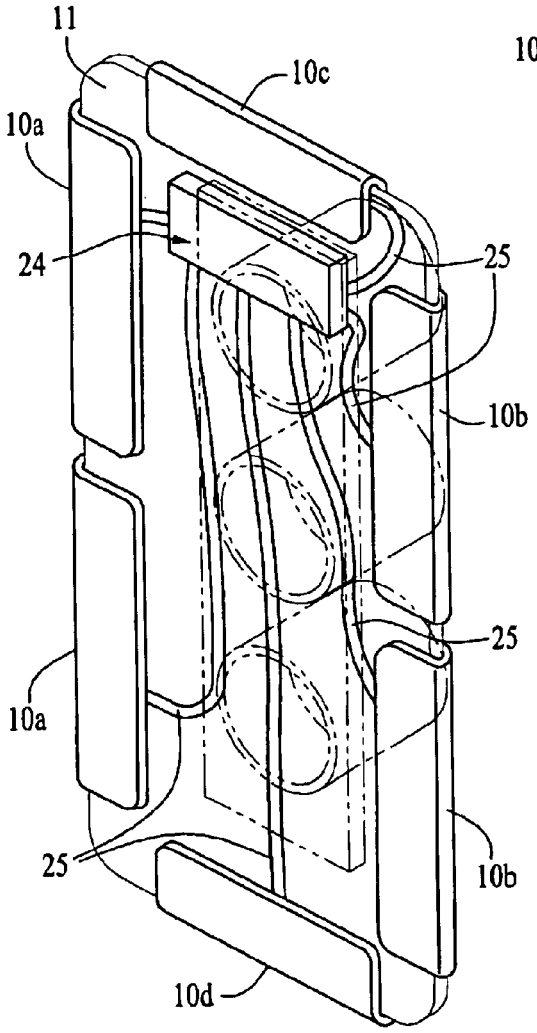
FIG. 4 is a rear perspective view of the device of FIG. 1.

The control system for the set of attachments 10 is shown in FIG. 4 and comprises a controller 24 mounted on the back of the backing panel 11 to receive signals from emergency vehicles via the antenna 20, and wires 25 electrically connecting the controller to each element. Because the construction and operation of such systems are well known, only the external layout of these elements is shown. And because the rearwardly facing sides of the attachment elements shown in FIG. 4 are not visible to approaching traffic, the display units can be omitted from that side of each of the channel-shaped bodies 21.

Figure 5:
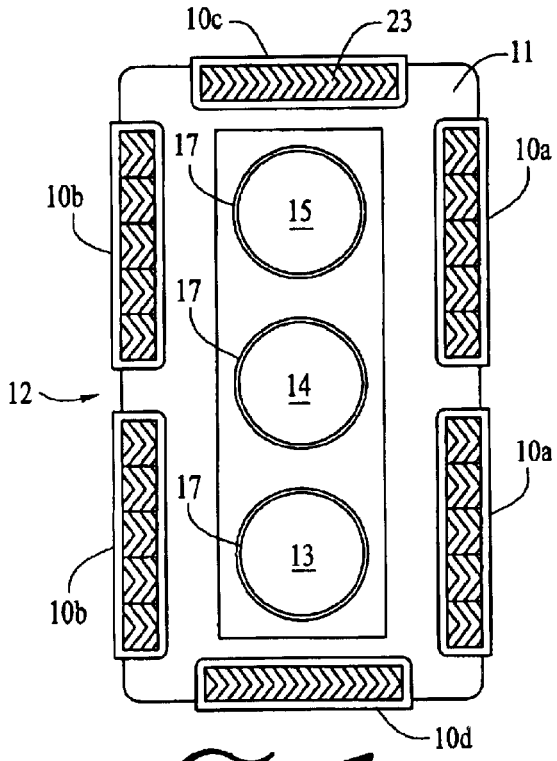
FIG. 5 is a front elevational view of the device of FIG. 1.
Figure 6:
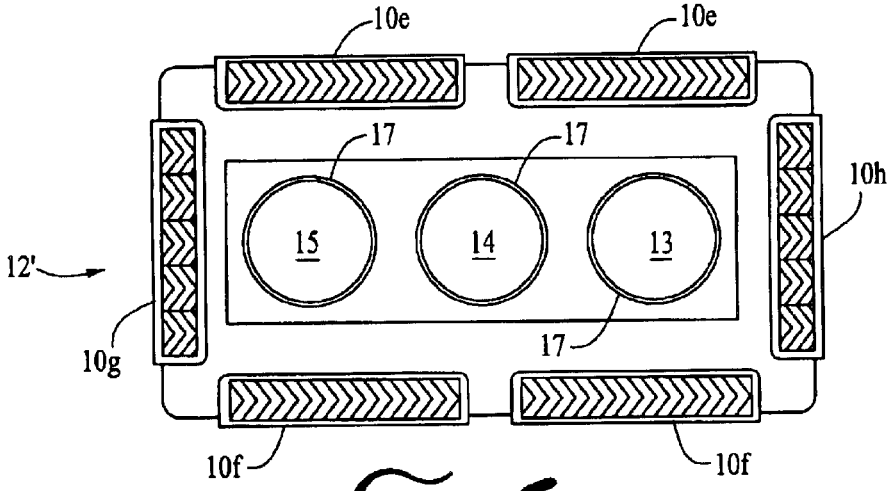
FIG. 6 is a front elevational view illustrating an alternative arrangement of the invention on a traffic signal in which the traffic lights are arranged horizontally.

FIGS. 5 and 6 illustrate different arrangements of attachment elements on vertical and horizontal traffic signals, FIG. 5 showing the arrangement of FIGS. 1 to 4, and FIG. 6 showing a modified traffic signal 12' in which three lamps 13, 14 and 15 are arranged in a horizontal row. In this case, two elongated attachment elements 10*c* and 10*f* are fitted on the upper and lower edges and only one attachment element 10*g*, 10*h* is fitted on each lateral side. The elongated elements 10*e* and 10*f* may be the same as the elements 10*c* and 10*d* used on the vertically oriented signal 12, and the elements 10*g* and 10*h* may be the same as the elements 10*a* and 10*b*, or they may be made a different length, as desired. In all other respects, this may be the same in construction and operation as in FIGS. 1 through 5.

Figure 7:
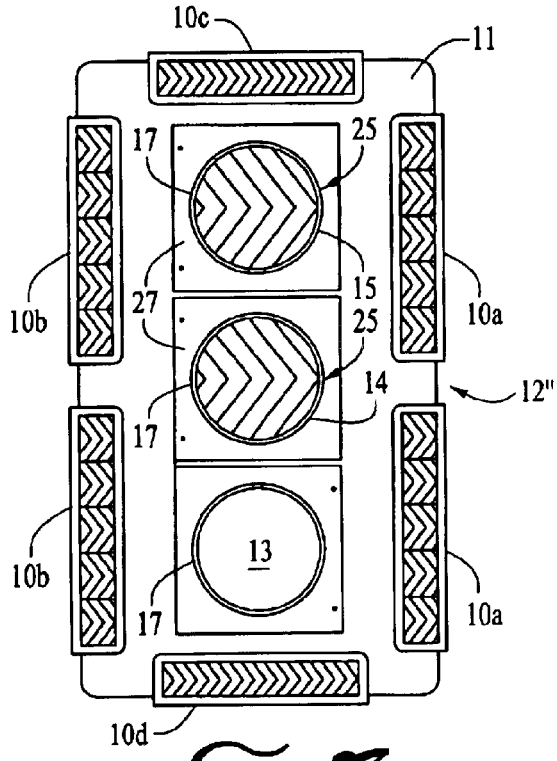
FIG. 7 is a front elevational view of a second embodiment of the invention in a traffic signal device having electro-optically responsive traffic signal lamps capable of producing graphic directional signals.
Figure 11:
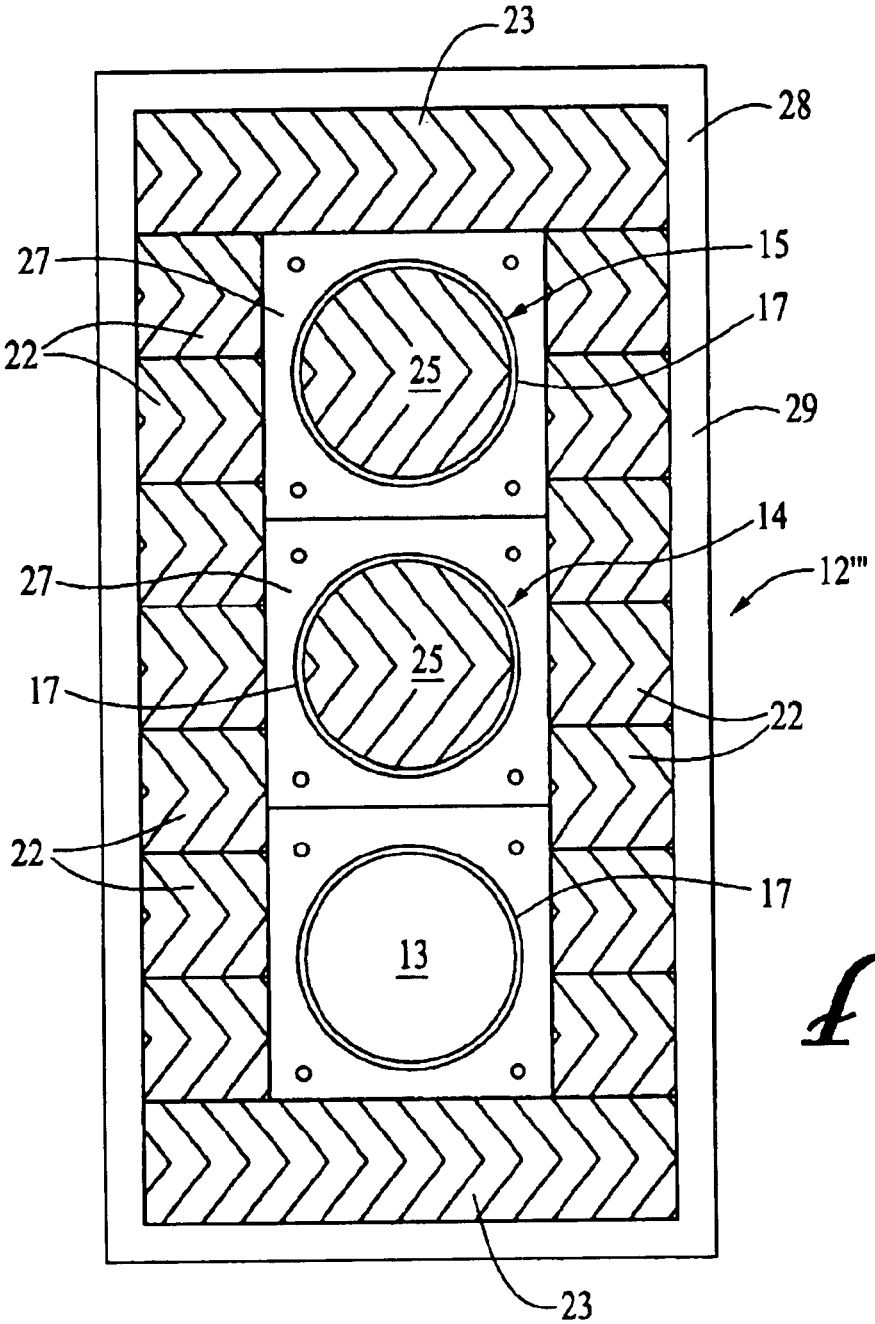
FIG. 11 is a front elevational view of a modified form of the second embodiment shown in FIG. 7, with attachments arranged in a row in a manner similar to that shown in FIG. 8.

A second embodiment of the invention is illustrated in FIG. 7 and in FIG. 11 in a modified form of traffic signal indicated at 12". In this embodiment, the device 10 comprising the attachment elements 10*a*, 10*b*, 10*c* and 10*d* is provided on the backing panel 11 as before, with one or more electro-optically responsive traffic signal lamps 25, and preferably two, that are capable of producing both the standard traffic signals during normal operations and directional or "stop" signals as well. Two of these traffic signal lamps are shown in FIGS. 7 and 11 and comprise circular arrays of LEDs that are mounted in plates 27 that are secured to the backing panel 11 in the normal positions of two of the regular lights, such as the yellow and green traffic lights. These arrays are capable of producing traffic directional signals (as well as the standard colored signals, during normal operation) and are shown with the chevron symbols that are among the preferred graphic symbols for directing lateral movement, selected from the group comprising chevrons and arrows. As before, these symbols may be given the appearance of lateral movement through sequential control of the activation of the LEDs, for optimum impact.

The modified form of this embodiment shown in FIG. 11 is a traffic signal 12'" having a backing panel 28 that is designed to receive a full peripheral set of display units 22 and 23, as original equipment, recessed into the backing plate and surrounded by a rim 29. Two electro-optically responsive traffic signal lamps 25, that may be identical to the lamps 25 of FIG. 7, are installed in the two upper traffic light positions at 14 and 15 with an appropriate controller and electrical connections (not shown) incorporated in the traffic signal and its control circuitry. Elongated upper and lower display units 23 extend fully across the upper and lower sides of the backing panel, and vertical rows of a plurality of square display units 22 extend in a row along each side of the panel. The result is an optimum directional display capability with a continuous band of display units around the traffic lights, combined with the directional display capability of the two lamps 25.

Figure 8:
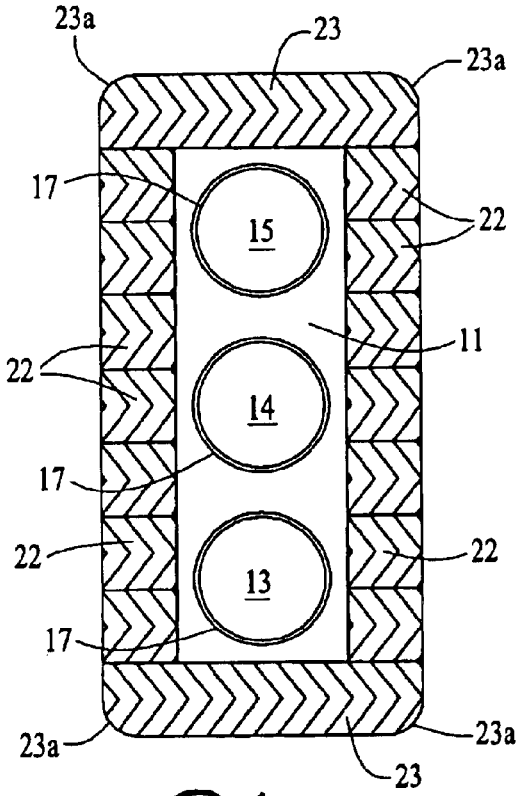
FIG. 8 is a front elevational view of a traffic signal similar to the signal in FIG. 1, in which the attachment elements are arranged in a continuous row around the traffic lights as original equipment.

Shown in FIG. 8 is a simplified form of the emergency traffic signal 12'" shown in FIG. 11, wherein the display units 22 and 23 are mounted on a backing panel as the border of the panel, and the three standard lamps 13, 14 and 15 are completely surrounded by the band of display units. The comers of the units are rounded at 23*a* for better appearance, but the display units otherwise are the same as in FIG. 11.

Figure 9:
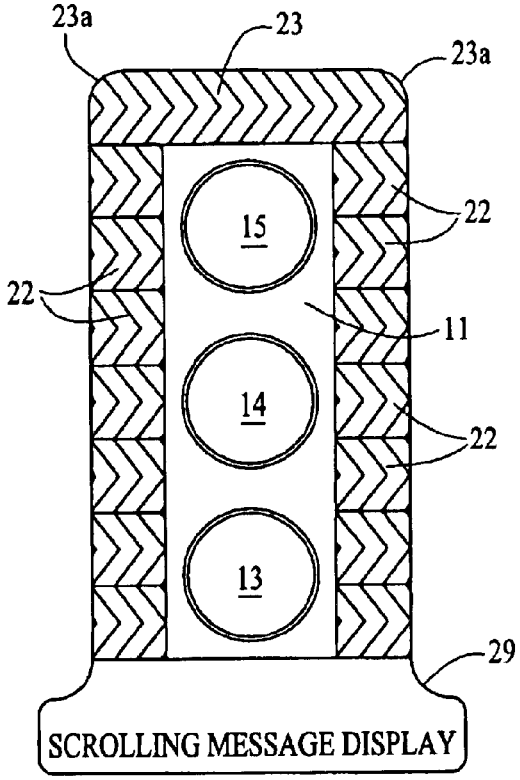
FIGS. 9 and 10 are front elevational views of a traffic signal device constituting a third embodiment of the invention, and showing two alternative arrangements of message display panels with "SCROLLING MESSAGE DISPLAY" in the position of a message to be displayed.
Figure 10:
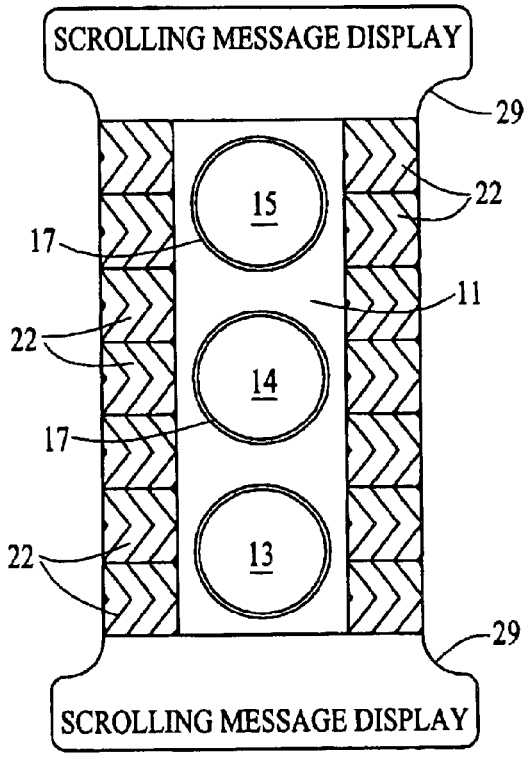

Shown in FIGS. 9 and 10 are two forms of a third embodiment of the invention, wherein one or more electro-optically responsive message display panels, indicated generally at 29, are attached to one or more sides of the backing panel of the traffic signal, replacing one or both of the display units 23. Herein one message panel 29 is attached to the lower side of the backing panel in FIG. 9, and two message panels 29 are attached to the upper and lower sides of the backing panel in FIG. 10. These message panels are denominated "SCROLLING MESSAGE DISPLAY" to illustrate the kind of verbal message that may be provided, in addition to graphic directional signals, or alternating with such graphic directional signals, which also can be displayed on the message display panels. These can be of conventional construction, including arrays of LEDs as in the case of the other electro-optically responsive components.

Figure 14:
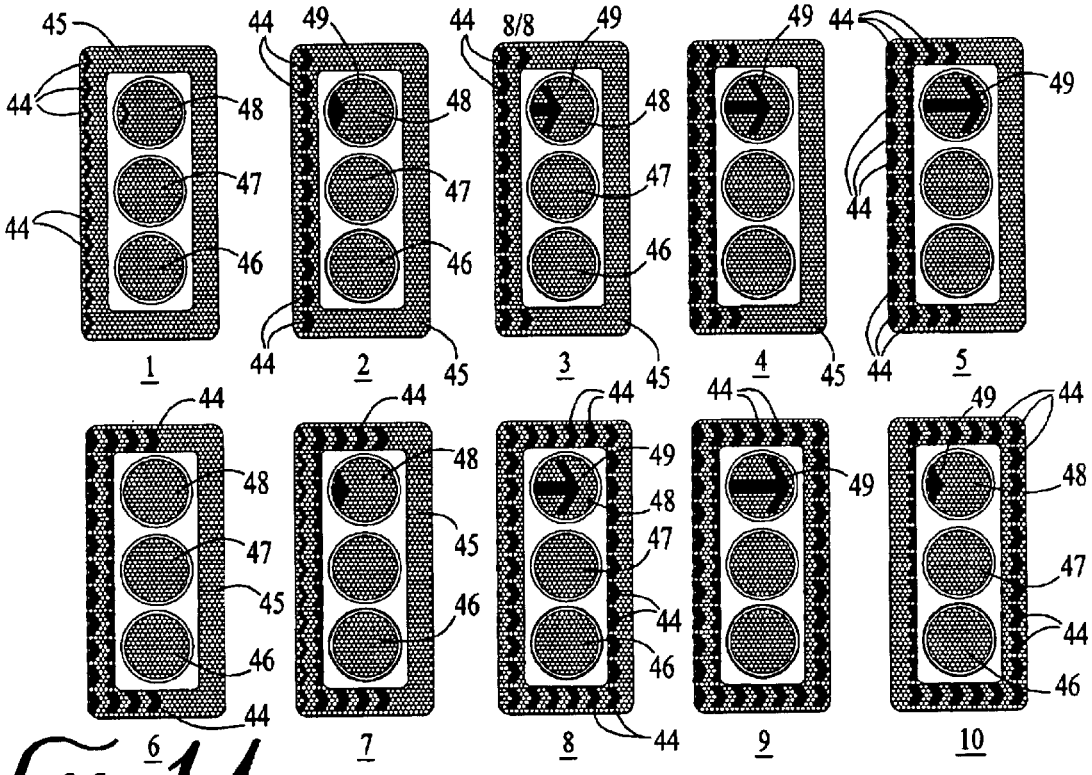
FIG. 14 is a schematic view illustrating the sequence of operations of the invention in an illustrative traffic signal of the type shown as the second embodiment, for the conditions represented by FIG. 12.

With one or more message panels, connected to and actuated by the controller as in the other embodiments, the emergency device has the additional capability of providing verbal messages, including, for example, the word "STOP" (see FIG. 15), or the word "RIGHT" or a variation (not shown) that could be displayed, for example, across the bottom of the band 45 in FIG. 14. With a message panel having the capability of scrolling even longer special messages, such as "Amber Alert" messages, can be provided, thereby enhancing the ability to communicate with approaching motorists.

Figure 12:
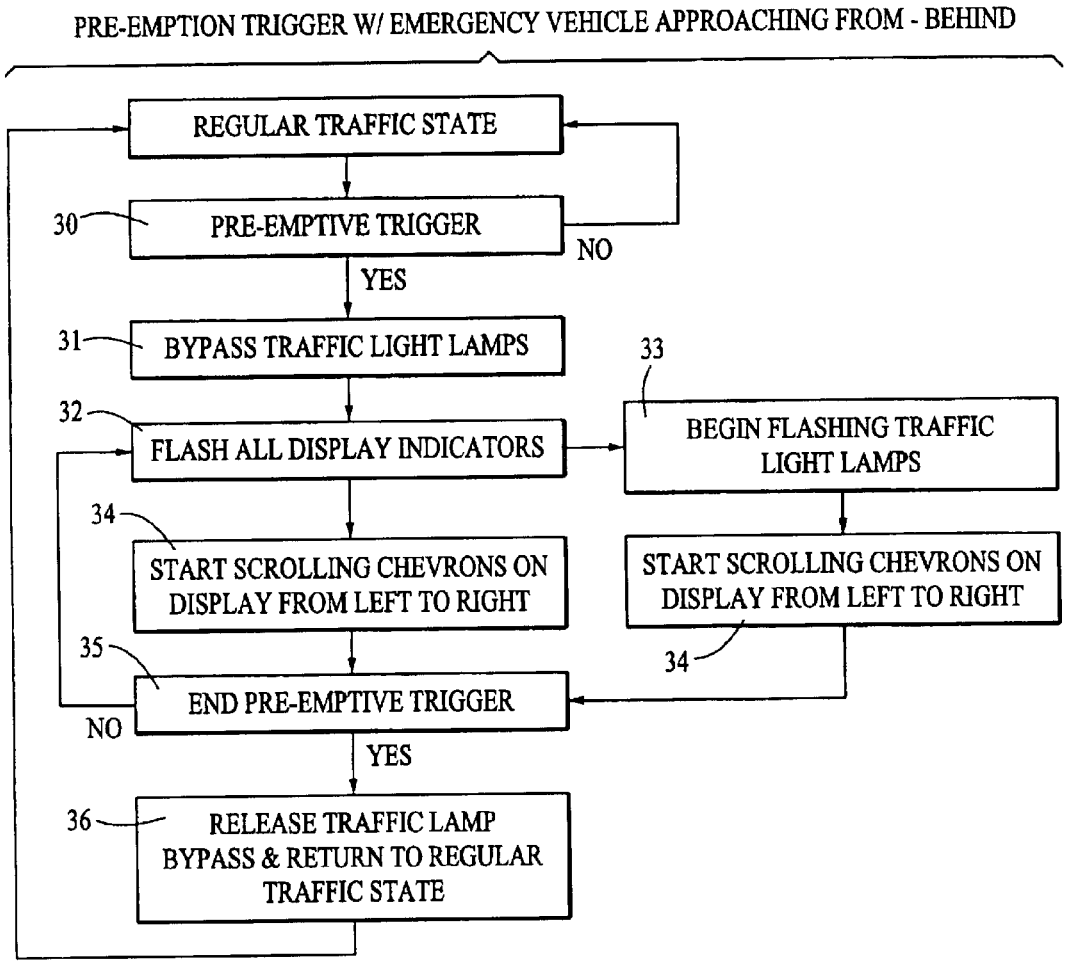
FIG. 12 is a flow chart showing representative sequences of operations in converting from normal operation of the traffic signal to emergency operation in response to a pre-emptive signal from an emergency vehicle approaching on the same roadway as the roadway controlled by the signal.
Figure 13:
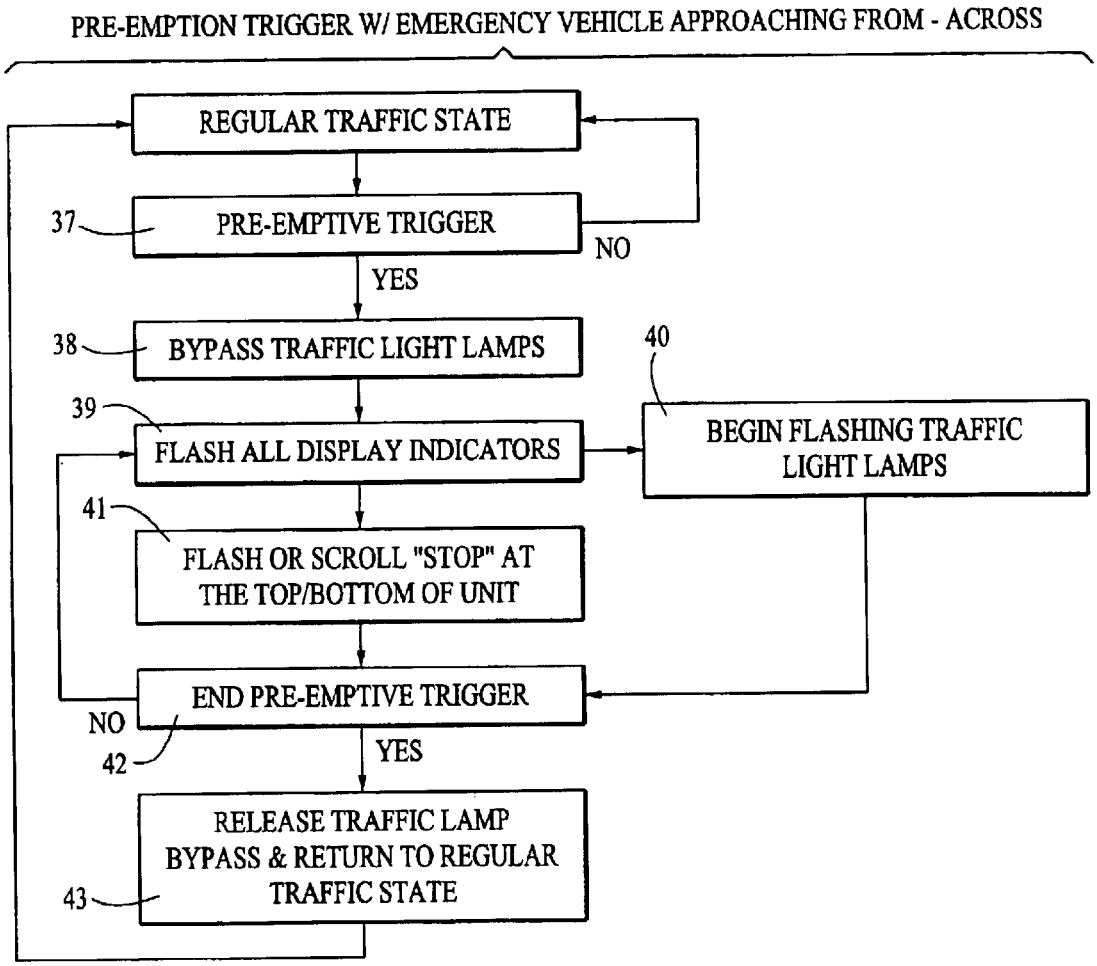
FIG. 13 is a flow chart similar to FIG. 12 but showing representative sequences of operations in response to a preemptive signal from an emergency vehicle approaching on an intersecting roadway.

Shown in FIGS. 12 and 13 are two representative flow charts of the functioning of the controller 24 of a system using an embodiment of the invention, for example, as shown in FIG. 9, with FIG. 12 showing the functions for conversion from normal to emergency conditions in response to a signal from a vehicle approaching the intersection on the same street or other roadway controlled by the traffic signal that is shown (referred to in FIG. 12 as "From Behind"), and FIG. 13 showing the functions for conversion from normal to emergency conditions in response to a signal from a vehicle approaching on a cross street (referred to as "From Across"). As can be seen in FIG. 12, the receipt of a "Pre-Emptive Trigger" signal (at 30) from the vehicle approaching on the same street results in the bypassing of a regular traffic light lamps (at 31) and begins the flashing of all display indicators (at 32) and the flashing of the regular traffic light lamps (at 33), and the scrolling of the chevrons on the display from left to right (at 33). When the preemptive signal ends (at 35), the traffic signal is returned to its normal state (at 36). Thus, motorists on the same roadway as the emergency vehicle are clearly and visibly instructed to move laterally to the side of the roadway.

As can be seen in FIG. 13, the receipt of a "Pre-Emptive Trigger" signal (at 37) from an emergency vehicle approaching on a cross street, as would occur simultaneously with the signal received in FIG. 12 for the street on which the emergency vehicle is travelling, results in the bypassing of the regular traffic light lamps (at 38) and begins the flashing of all display indicators (at 39) and traffic lights (at 40). At the same time, the controller will flash or scroll the appropriate verbal message on the message display panel, such as "STOP" for added emphasis and clarity (at 41). When the preemptive trigger signal ends (at 42), the traffic signal is returned to its normal state (at 43).

Figure 15:
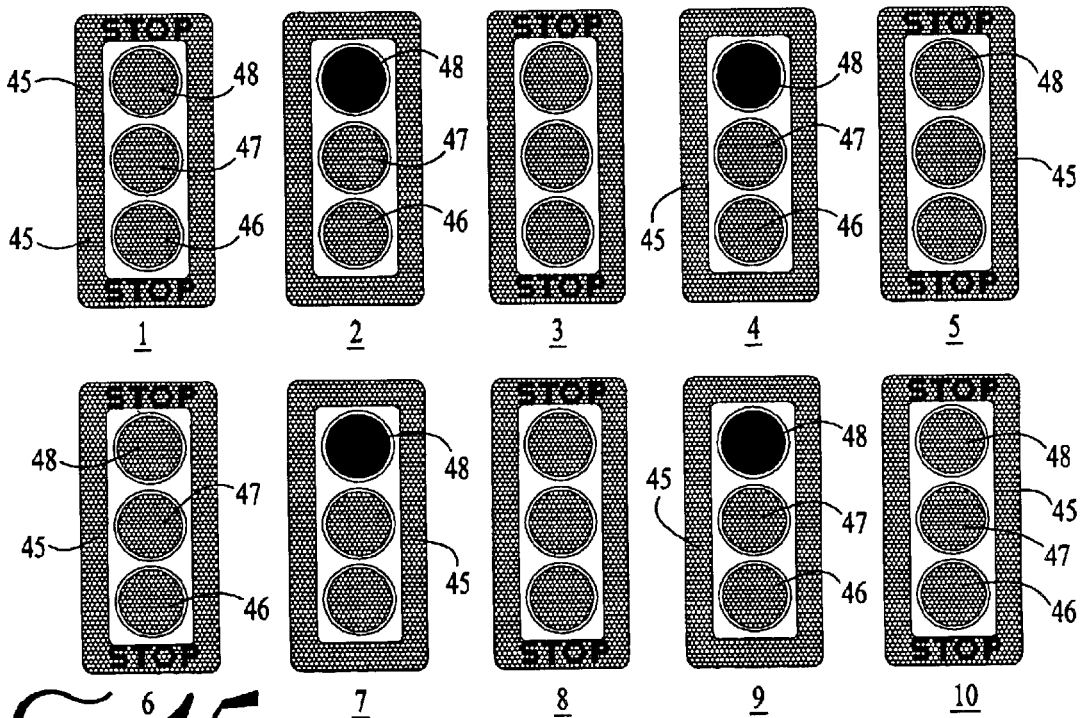
FIG. 15 is a schematic view similar to FIG. 14 illustrating the sequence of operation for the conditions represented by FIG. 13.

FIGS. 14 and 15 illustrate in diagrammatic form some of the visual display indicators that can be provided, including a moving display indicator chevron pattern (FIG. 14) for the "same street" condition, and flashing visual and verbal display indicators for the "cross street" condition (FIG. 15). In the traffic signal device that is shown diagrammatically in these figures, chevrons 44 are displayed on an electro-optically responsive border 45 surrounding the three traffic lights 46, 47 and 48 that are shown, and the upper traffic light 48 has the capability of displaying a visual indicator 49 in apparently moving form, herein an arrow instead of the chevron pattern shown in FIGS. 7 and 11.

At the beginning of the flashing and scrolling functions at 32, 33 and 34 in FIG. 12, the chevrons 44 appear along on the left-hand edge of the traffic light, as shown at position "1" in FIG. 14, and the tip of the arrow 49 appears on the left side of the upper lamp 48. In the next condition, shown in position "2," the chevrons and the arrow have moved to the right, and this continues progressively through position "5" where the full arrow 49 is displayed. In position "6," the arrow has disappeared, and in position "7" through "9" the arrow and the chevrons progress toward the right. In position "10," the chevrons appear to continue to the right and to move off the signal while the arrow reappears (tip only), as shown. The traffic lights preferably will flash "red" during this process.

Similarly with reference to FIG. 14, at the beginning of the flashing and scrolling functions at 39, 40 and 41 in FIG. 13, the word "STOP" is flashed or scrolled into view on the message display panel(s) or on other LED displays, as indicated diagrammatically on the top and bottom in position "1" of FIG. 15, and the upper "stop" light also begins to flash on and off, as indicated in this representative sequence. As shown, the verbal "STOP" message alternates with the flashing visual "stop" light for a highly effective warning. It should be noted that other variations and additions may be included in this circuitry, including the flashing of the entire border pattern with the "STOP" message or with the "stop" light, and various other patterns that are readily available with a traffic signal device of this type.

The basic method of the invention will be apparent from the foregoing description of the components, capabilities and operation of the invention. It comprises the providing of a set of elongated attachment elements having electro-optically responsive display units, as has been described, preferably arrays of LEDs, affixing the attachment elements to the traffic signal around the lamps forming the traffic lights, either as retrofitted elements or as original equipment, and either forming an interrupted pattern or a substantially continuous peripheral band around the lights, and providing a controller for detecting preemptive emergency signals, determining the direction from which the signals are approaching, and actuating the display units to display the appropriate graphic display signals. In addition, the method contemplates the step of providing one or more message display panels along a selected side or sides of the backing panel and actuating that panel through the controller to display preselected verbal messages, and the step of providing one or more electro-optically responsive display panels for one or more of the traffic signal lamps, and controlling the display panel through the controller in response to the preemptive emergency signals to provide a second graphic directional signal, thereby enhancing or augmenting the signals given by the attachment elements around the traffic lights. Also included as an available step is the flashing of all display indicators as a part of the sequence, for even greater attention-getting capability.

From the foregoing descriptions and explanations of the various embodiments and modified forms of the invention that are shown herein for purposes of illustration, it will be evident that the invention provides a highly visible and clear indication of the actions that are required of motorists who are in or approaching an intersection as an emergency vehicle also is approaching that intersection, whether on the same street or other roadway on which the motorist is travelling or on an intersecting street or roadway. It also will be evident that the basic concept of the invention is to provide a visual display that is mounted on the traffic signal around the standard traffic lights, either as separated elements or as a continuous band, and providing highly visible directional signals as symbols, the preferred symbols being chevrons or arrows, as described, but not being limited to these two choices. Moreover, the several examples given of ways to mount the attachment elements on the traffic signal are intended to show that there are numerous modifications that may be made in this respect, and the intent is to cover all such modifications herein, and to adapt the invention to all of the various forms that traffic signals may take. The controller 20 and display units or plates 22, 23 and 25 are shown only generally, with representative symbols displayed thereon (as in the actuated state), and are described only generally as arrays of LEDs because such arrays are known and used for other purposes and in other environments. While this is the presently preferred form of electro-optically responsive display units, it is believed that other suitable units also may be used for the same purposes. Accordingly, it is intended to cover all modifications and changes of the illustrative embodiments of the invention that are within the spirit and scope of the invention.

We claim as our invention:

1. An emergency traffic signal device for use as a traffic signal to be actuated by a preemptive emergency signal from an approaching emergency vehicle, said device comprising:

a backing panel for said traffic signal having top, bottom and side edges and a plurality of traffic lights mounted in a row on said backing panel;

a plurality of elongated display elements mounted on said backing panel and extending along the edges thereof around said traffic lights, each of said display elements comprising at least one electro-optically responsive display unit operable when actuated to display a preselected graphic directional symbol for directing motorists approaching the traffic signal device;

and a controller for said display elements connected to the elements and responsive to said preemptive emergency signal to actuate the elements and produce said preselected directional symbols thereon.

2. An emergency traffic signal device as defined in claim 1 wherein said elongated display elements comprise elongated attachment elements each having a channel-shaped body for filling over one of said edges and a front side portion for overlying the backing panel.

3. An emergency traffic signal device as defined in claim 1 wherein said elongated display elements are mounted on said backing plate within channels formed in said plate around said traffic lights.

4. An emergency traffic signal device as defined in claim 3 wherein said elongated display elements form a substantially continuous peripheral band around said backing panel.

5. An emergency traffic signal device as defined in claim 1 wherein said elongated display elements surround said backing plate as a peripheral band.

6. An emergency traffic signal device as defined in claim 1 wherein said elongated display elements further including at least one message display panel mounted on said backing panel and operable to display selected instructional messages.

7. An emergency traffic signal device as defined in claim 6 wherein two such message display panels are mounted on opposite sides of said traffic lights.

8. An emergency traffic signal device as defined in claim 1 further including at least one electro-optically responsive display panel for overlying one of said traffic lights and operable to limit colored traffic signal light during standard operation, and operable when actuated by said controller to display a preselected graphic display symbol.

9. An emergency traffic signal device as defined in claim 1 wherein said electro-optically responsive display units are arrays of LEDs.

10. An emergency traffic signal device as defined in claim 8 wherein said electro-optically responsive display panel is an array of LEDs.

11. An emergency traffic signal device for use on a traffic signal having traffic lights mounted on a backing panel with a front side having generally horizontal and vertical side edges, to be actuated by a preemptive emergency signal from an approaching emergency vehicle, said device comprising:

a set of elongated attachment elements mountable along the horizontal and vertical edges of the backing panel and each having a channel-shaped body for fitting over one of said edges and a front side portion for overlying the front side of the backing panel;

at least one electro-optically responsive display unit mounted on each of said attachment elements on said front side portion thereof and operable when actuated to display a preselected graphic directional symbol;

and a controller for said attachment elements connected to the elements and responsive to said preemptive emergency signal to actuate the elements and produce said preselected directional symbols thereon.

12. An emergency traffic signal device as defined in claim 11 wherein said backing plate has upper, lower, and side edges and said set of attachment elements includes at least one element on each of said sides.

13. An emergency traffic signal device as defined in claim 11 wherein said display units are arrays of LEDs capable of being actuated in preselected patterns to display the preselected graphic directional symbols.

14. An emergency traffic signal device as defined in claim 13 wherein said symbols are selected from the group comprising chevrons and arrows.

15. An emergency traffic signal device as defined in claim 11 wherein said backing panel is rectangular, having upper, lower and elongated side edges, and said set of attachment elements includes two elements on each elongated side edge and one element on each of said upper and lower edges.

16. An emergency traffic signal device as defined in claim 11 wherein said backing panel is rectangular, having elongated upper and lower edges and shorter side edges, and said set of attachment elements includes two elements on each of the elongated upper and lower edges and one element on each of the shorter side edges.

17. An emergency traffic signal device as defined in claim 11 wherein said controller is mountable on said backing panel and is connected by wires to the respective attachment elements.

18. An emergency traffic signal device as defined in claim 11 further including at least one electro-optically responsive lamp mounted on one of said traffic lights and connected to said controller, said electro-optically responsive lamp being capable of providing a standard light during standard operation of the traffic signal and being capable of providing a preselected directional symbol in response to the preemptive emergency signal.

19. An emergency traffic signal device as defined in claim 18 wherein said preselected directional symbol is selected from the group comprising chevrons and arrows.

20. The method of controlling a traffic signal having a plurality of traffic lights arranged in a row on a backing panel top, bottom and side edges, in response to preemptive emergency signals for overriding normal operation of the traffic signal, the traffic signal being disposed at an intersection of roadways, comprising the steps of:

providing a set of elongated attachment elements for the traffic signal having electro-optically responsive display units that are operable when actuated to display a preselected graphic directional symbol for lateral movement;

affixing the attachment elements to the backing panel around the traffic lights along said edges;

and providing a controller for detecting the preemptive emergency signal, determining the direction from which the signals are approaching the controller, and actuating said display units to display the preselected graphic directional signal;

and actuating said display units through said controller to actuate said display units when lateral movement is appropriate.

21. The method as defined in claim 20 wherein the backing panel has top, bottom and side edges and the affixing step includes the positioning of at least one of the attachment elements along each of the edges.

22. The method as defined in claim 20 including the further step of providing at least one message display panel on said backing panel along one of said edges, and actuating said message display panel through said controller in response to the preemptive emergency signal.

23. The method as defined in claim 22 further including the steps of providing an electro-optically responsive display panel to serve as at least one of said traffic lights, and controlling said display panel through said controller to provide a second preselected graphic directional signal in response to the preemptive emergency symbol.

24. The method as defined in claim 20 including the further step of operating said controller to flash the display units while providing the directional symbols.

25. The method as defined in claim 23 wherein said second preselected graphic directional signal is selected from the group comprising chevrons and arrows.

* * * * *